US006896600B1

(12) United States Patent
Wu et al.

(10) Patent No.: US 6,896,600 B1
(45) Date of Patent: May 24, 2005

(54) LIQUID DISPENSE MANIFOLD FOR CHEMICAL-MECHANICAL POLISHER

(75) Inventors: Patrick P. H. Wu, Sunnyvale, CA (US); Xuyen Pham, Fremont, CA (US); Tony Luong, San Jose, CA (US)

(73) Assignee: LAM Research Corporation, Fremont, CA (US)

( * ) Notice: Subject to any disclaimer, the term of this patent is extended or adjusted under 35 U.S.C. 154(b) by 155 days.

(21) Appl. No.: 10/112,421

(22) Filed: Mar. 29, 2002

(51) Int. Cl.[7] ..... B24B 57/00

(52) U.S. Cl. ..... 451/307; 451/60; 451/446; 222/420; 222/568; 239/550

(58) Field of Search ..... 451/307, 306, 451/36, 41, 59, 60, 285, 287, 288, 446, 102, 451/443; 438/692, 693, 691; 156/345, 345.12; 15/77, 88.3; 222/630, 420, 566–568; 239/550

(56) References Cited

U.S. PATENT DOCUMENTS 2,428,276 A * 9/1947 Griswold ..... 451/102
2,594,735 A * 4/1952 Crumley ..... 451/102
4,702,689 A * 10/1987 Schmidt et al. ..... 425/548
5,868,608 A * 2/1999 Allman et al. ..... 451/72
6,116,991 A 9/2000 Liu et al.
6,622,335 B1 * 9/2003 Anderson et al. ..... 15/77

* cited by examiner

*Primary Examiner*—Hadi Shakeri
(74) *Attorney, Agent, or Firm*—Martine Penilla & Gencarella, LLP

(57) ABSTRACT

A liquid dispense manifold having drip nozzles configured to form controlled droplets is provided for use in chemical-mechanical polisher (CMP) systems. The liquid dispense manifold includes a plurality of drip nozzles that are secured to the side of the liquid dispense manifold. Each of the plurality of drip nozzles has a passage defined between a first end and a second end. A bend is defined within the drip nozzle passage such that droplets are directed downward toward a polishing surface. The nozzles are configured with respect to the manifold to provide an even flow rate of substantially uniform drops onto the polishing surface.

11 Claims, 14 Drawing Sheets

LIQUID DISPENSE MANIFOLD FOR CHEMICAL-MECHANICAL POLISHER

BACKGROUND OF THE INVENTION

1. Field of the Invention

The present invention relates to semiconductor wafer polishing, buffing, and cleaning and, more particularly, to techniques for applying liquids over a polishing belt in a Chemical-Mechanical Polishing (CMP) system.

2. Description of the Related Art

In the fabrication of semiconductor devices, there is a need to perform Chemical-Mechanical Polishing operations, including polishing, buffing, cleaning, and planarization of semiconductor wafers. Typically, integrated circuit devices are in the form of multi-level structures. At the substrate level, transistor devices having diffusion regions are formed. In subsequent levels, interconnect metallization lines are patterned and electrically connected to the transistor devices to define the desired functional device. As is well known, patterned conductive layers are insulated from other conductive layers by dielectric materials, such as silicon dioxide. As more metallization levels and associated dielectric layers are formed, the need to planarize the dielectric material increases. Without planarization, fabrication of additional metallization layers becomes substantially more difficult due to the higher variations in the surface topography. In other applications, metallization line patterns are formed in the dielectric material, and then metal CMP operations are performed to remove excess metallization.

In the prior art, CMP systems typically implement belt, orbital, or brush stations in which belts, pads, or brushes are used to scrub, buff, polish, and planarize one or both sides of a wafer. Slurry is used to facilitate and enhance the CMP operation. Slurry is most usually introduced onto a moving preparation surface, e.g., belt, pad, brush, and the like, and distributed over the preparation surface as well as the surface of the semiconductor wafer being buffed, polished, or otherwise prepared by the CMP process. The distribution is generally accomplished by a combination of the movement of the preparation surface, the movement of the semiconductor wafer and the friction created between the semiconductor wafer and the preparation surface.

FIG. 1A illustrates an exemplary prior art CMP system 100. The CMP system 100 in FIG. 1A is a belt-type system, so designated because the preparation surface is an endless polishing belt 102 mounted on two drums 104 which drive the belt 102 in a rotational motion as indicated by belt rotation directional arrow 106. A wafer 108 is mounted on a carrier head 110. The carrier head 110 is rotated in direction 112. The rotating wafer 108 is then applied against the rotating polishing belt 102 with a force F transmitted through the carrier head shaft 114 to accomplish a CMP process. Some CMP processes require significant force F to be applied. A platen 116 is provided to stabilize the belt 102 and to provide a solid surface onto which to apply the wafer 108. Slurry 118 composed of an aqueous solution, such as $NH_4OH$ or DI containing dispersed abrasive particles is introduced to an application region 120 upstream of the wafer 108. FIG. 1A illustrates the use of a single point slurry 118 distribution apparatus composed of a single tube 122 having an attached dispensing head 124.

FIGS. 1B and 1C illustrate a prior art manifold-type slurry distribution apparatus 150 that has been used as an alternative to the single point slurry distribution apparatus. The lower region of the manifold 150 has a bore 152 through its length with an input 154 at one end and an output 156 at the other end. A number (approx. 9) of threaded holes 158 extend downward from the bore 152 toward the polishing belt 102. Each threaded hole 158 receives a threaded nozzle 160. The bore-end of each nozzle 160 contains a sapphire orifice 162 which is sized to control the slurry 118 flow. A tube 164 is connected between the bore output 156 and the input of a manual metering valve 166. Another tube 168 is connected to the manual metering valve 166 output and travels through one of several ports 170 at the upper region of the manifold 150. The tube 168 may be placed through any one of the ports 170 depending on where extra slurry 118 is required on the belt 102. The manual metering valve 166 is used to control the slurry flow through tube 168. The manual metering valve 166 may be on, off, or regulated. The slurry 118 is provided to the manifold 150 through an input tube 172 in the direction indicated by arrow 174. Due to the small diameter (e.g., 0.029 inch) of the sapphire orifices 162, the slurry 118 will not enter the nozzles 160 unless the bore 152 is pressurized. The pressurization requirement to initiate flow through the sapphire orifices 162 results in an even flow distribution through each nozzle 160. The sapphire orifices 162, nozzle 160 configuration, and bore 152 pressurization causes the slurry 118 to leave nozzles 160 as drops. The slurry application area 176 resulting from the manifold-type slurry distribution apparatus 150 covers more of the polishing belt 102 width than the application area 120 corresponding to the single point slurry distribution apparatus.

The primary limitation of the single point slurry distribution apparatus (122 and 124) is its limited slurry application area 120. In the prior art, the manifold-type slurry distribution apparatus 150 was developed to provide a wider, more evenly distributed slurry application area 176. However, there are a number of problems associated with the manifold-type slurry distribution apparatus 150.

The manifold-type slurry distribution apparatus 150 was originally developed to place liquid such as water on a cleaning brush. In the present CMP application, the slurry 118 chemistry, higher density, and higher viscosity relative to water, results in a higher potential for clogging of the extremely small (~0.029 inch diameter) sapphire orifices 162. Thus, one problem with the prior art is the susceptibility to clogging of the small orifice nozzles 160. Making the diameter larger would have the downside of producing an un-even flow out of each of the nozzles 160.

When slurry 118 dries in the nozzles 160 and sapphire orifices 162, it becomes cemented such that it cannot be easily removed. Attempts to remove dried slurry often result in broken components within the bore 152 such as sapphire orifices 162 and nozzles 160. When these components break in the bore, it is not typically possible to repair the manifold. Thus, the entire manifold 150 must be replaced. In the prior art, the nozzles 160 and sapphire orifices 162 must be machined to satisfy surface finish requirements. The manifold-type slurry distribution apparatus 150 is expensive due to its materials and many machined components. Therefore, servicing difficulties requiring replacement of the manifold-type slurry distribution apparatus 150 are very costly.

In view of the foregoing, there is a need for a slurry distribution apparatus that avoids the problems of the prior art by minimizing clogging potential, improving serviceability, and decreasing replacement frequency and cost.

SUMMARY OF THE INVENTION

Broadly speaking, the present invention fills these needs by providing an improved method for dispensing liquid (e.g., slurry) over the polishing belt of a CMP system. It should be appreciated that the present invention can be implemented in numerous ways, including as a process, an apparatus, a system, a device, or a method. Several inventive embodiments of the present invention are described below.

In one embodiment, a liquid dispense manifold for use in a chemical-mechanical planarization (CMP) system is disclosed. The system includes a plurality of drip nozzles that are attached to a side wall of the liquid dispense manifold. Each drip nozzle includes a first end and a second end and a passage defined there-between. The first end is attached to the side wall. A bend is defined within the passage of each drip nozzle, and the bend is configured to direct a fluid stream substantially parallel to the side wall as it is directed toward the second end. The fluid stream is configured to be released from each drip nozzle in the form of substantially uniform drops.

In another embodiment, a fluid dispense manifold is provided the fluid dispense manifold is defined by an elongated body having at least a length, a bottom region, and a side region. A bore is defined through the length of the elongated body, and a plurality of holes are defined along the length of the elongated body and defined into the side region. Each of the plurality of holes are positioned toward an upper inner region of the bore. A plurality of nozzles are provided. Each of the plurality of nozzles is capable of being attached to each of the plurality of holes, and each nozzle has a bend designed to direct a fluid flow capable of emanating from within the bore, out through the side region and toward the bottom region. The fluid flow is capable of being directed onto a surface that is oriented beneath the bottom region.

In yet another embodiment, a method for making a fluid manifold is disclosed. the method includes providing an elongated block of material. The elongated block of material has a side surface and a bottom surface. Then, boring a hole through a center of the elongated block of material. A plurality of holes are formed along the elongated block, and the plurality of holes are defined on the side surface of the elongated block of material. The method further includes applying a bent nozzle to each of the plurality of holes. Each of the bent nozzles configured to direct outwardly from the side surface and curve downwardly in the direction of the bottom surface.

In still another embodiment, a liquid dispense manifold for use in CMP operations is disclosed. The front side of the manifold is separated into an overhanging upper half and a recessed lower half. A plurality of nozzles are secured along each of the upper and lower halves of the front side of the manifold. Two bore holes pass through the length of the manifold such that each bore hole lies in either the upper or lower half of the manifold and is within close proximity to the front side of the manifold. Each of the plurality of nozzles along the front of the manifold has a passage defined between a first end and a second end. A single 90 degree bend exists within each nozzle passage so that liquid can exit the front side of the manifold and be directed downward toward the CMP polishing belt. The nozzles are positioned and configured to provide an evenly distributed dispensation of liquid from the manifold to the polishing belt. The presence of two bore holes allow the use of one or two liquid types without concern for liquid type mixing within a bore hole region. Liquid input lines may be connected to either end of the bore holes. Similarly, end caps or other lines may be connected to the non-input ends of the bore holes.

In another embodiment, a liquid dispense manifold for use in CMP operations is disclosed. The manifold is a rectangular block containing a bore hole which passes through the manifold within close proximity to the front side of the manifold. A plurality of nozzles are secured along the front side of the manifold. Each of the plurality of nozzles along the front of the manifold has a passage defined between a first end and a second end. A single bend (e.g., 90 degrees) exists within each nozzle passage so that liquid can exit the front side of the manifold and be directed downward toward the CMP polishing belt. The nozzles are positioned and configured to provide an evenly distributed dispensation of liquid from the manifold to the polishing belt. A liquid input line may be connected to either end of the bore hole. Similarly, an end cap or other line may be connected to the non-input end of the bore hole.

The advantages of the present invention are numerous. Most notably, by designing a liquid dispense manifold which directs liquid to flow through the manifold side prior to turning downward in a nozzle passage, the liquid flow may be controlled and conditioned by means other than those involving gravity, extremely small sapphire orifices, and machined components. Also, the simplicity of the liquid dispense manifold facilitates servicing and repair. The claimed invention therefore solves the problem of liquid clogging that previously would result in an irreparable condition. Also, the simplicity of the embodiments of the claimed invention removes the problem of unserviceable components that previously could yield the manifold irreparable, thus, requiring complete replacement at high cost.

Other aspects and advantages of the invention will become more apparent from the following detailed description, taken in conjunction with the accompanying drawings, illustrating by way of example the present invention.

BRIEF DESCRIPTION OF THE DRAWINGS

The invention, together with further advantages thereof, may best be understood by reference to the following description taken in conjunction with the accompanying drawings in which.

DETAILED DESCRIPTION OF THE PREFERRED EMBODIMENTS

An invention is disclosed for a liquid dispense manifold for a CMP system. The liquid dispense manifold of the present invention uses nozzles which provide a liquid flow path from the side of the manifold downward at an angle (e.g., 90 degrees) toward a CMP polishing belt, thus eliminating the liquid clogging and serviceability issues associated with bottom-exit small orifice nozzles. Further, the manifold of the present invention successfully implements less expensive materials of construction with lower precision dimensional requirements, thus yielding a better performing, less costly, and more easily serviceable alternative with respect to the prior art.

In the following description, numerous specific details are set forth in order to provide a thorough understanding of the present invention. It will be apparent, however, to one skilled in the art that the present invention may be practiced without some or all of these specific details. In other instances, well known process operations have not been described in detail in order not to unnecessarily obscure the present invention.

Figure 1A:
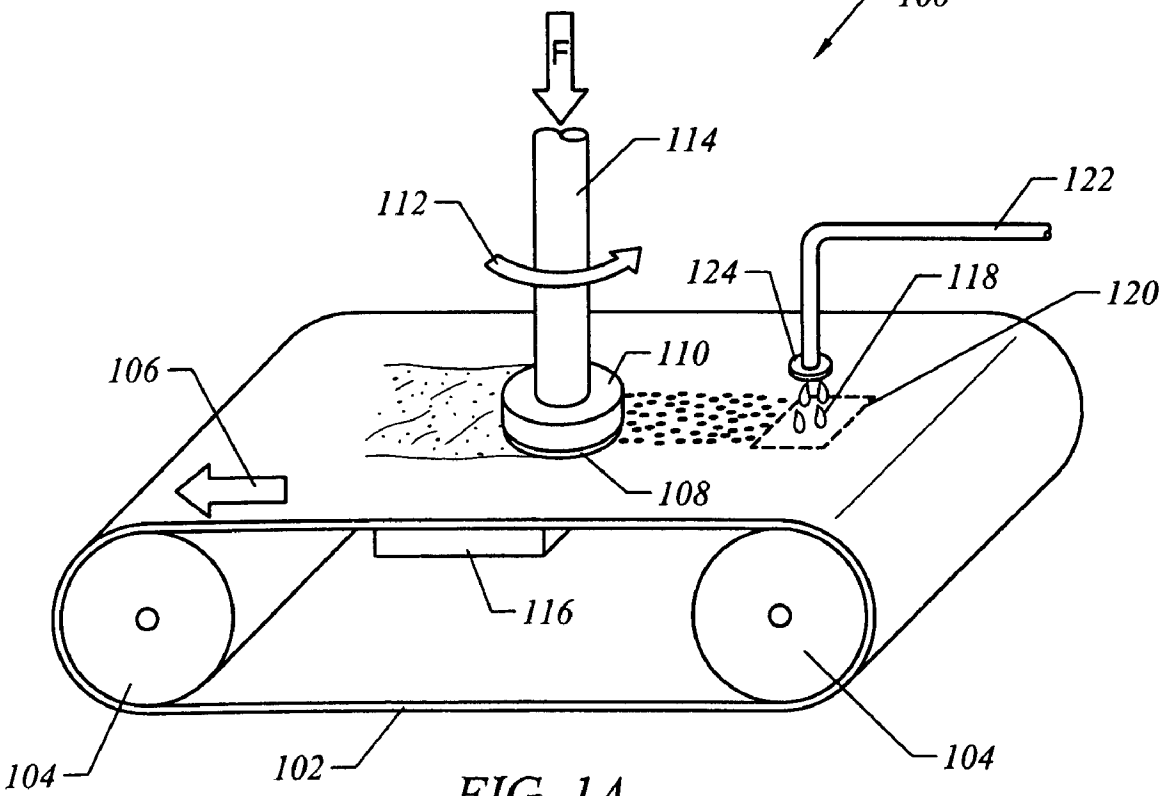
FIG. 1A (Prior Art)
FIG. 1A is an illustration showing an exemplary prior art CMP system.
Figure 1B:
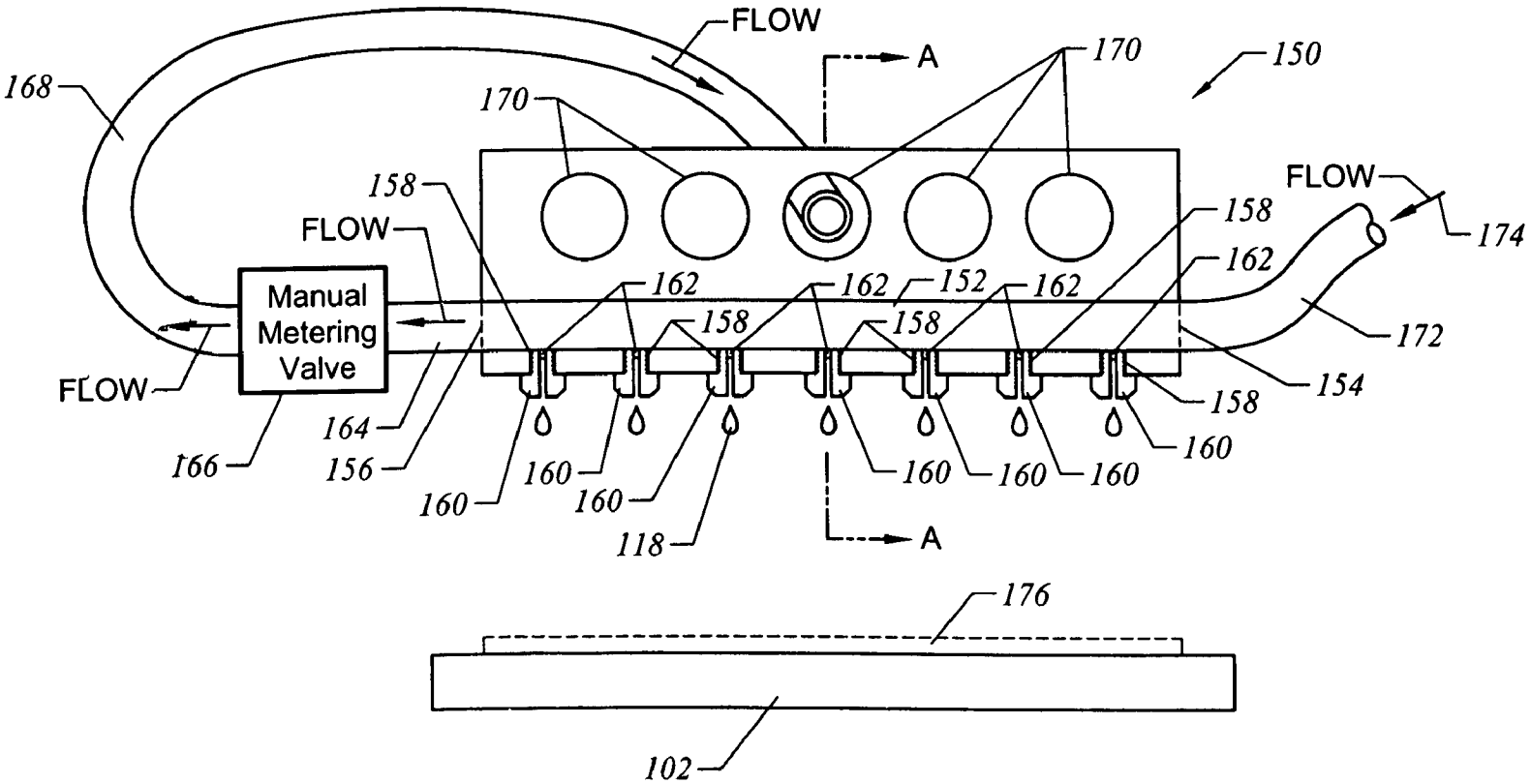
FIG. 1B (Prior Art)
FIG. 1B is an illustration showing the longitudinal cross-section of an alternative prior art manifold-type slurry distribution apparatus.
Figure 1C:
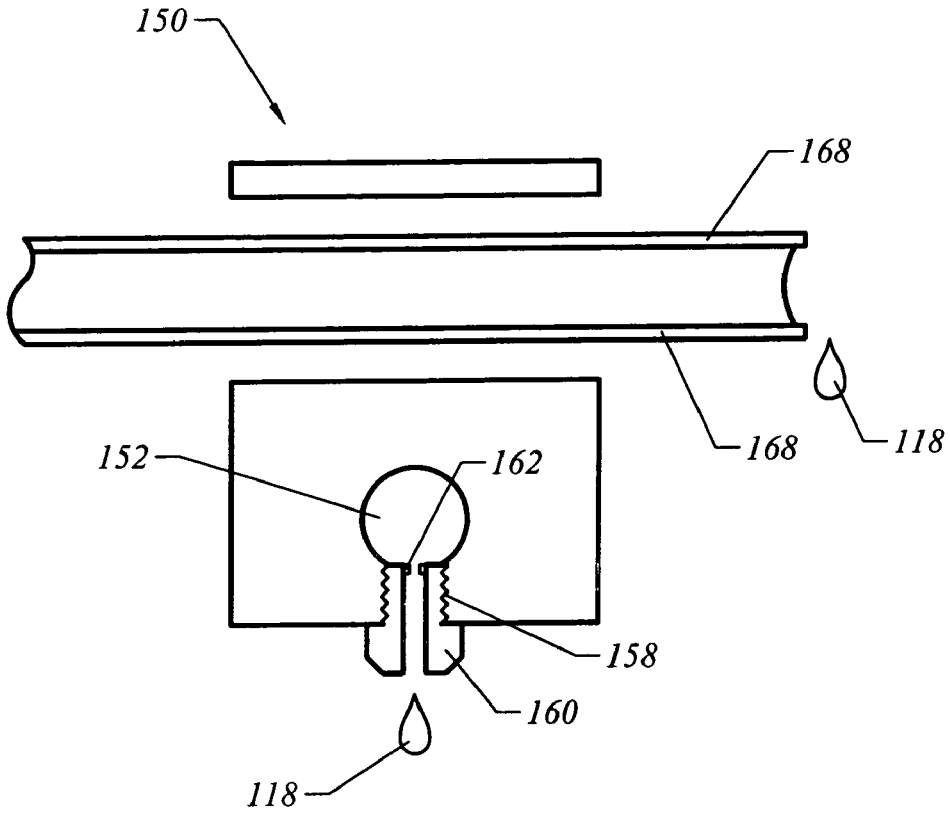
FIG. 1C (Prior Art)
FIG. 1C shows a side cross-sectional view, referenced as A—A in FIG. 1B, of the alternative prior art manifold-type slurry distribution apparatus.
Figure 2A:
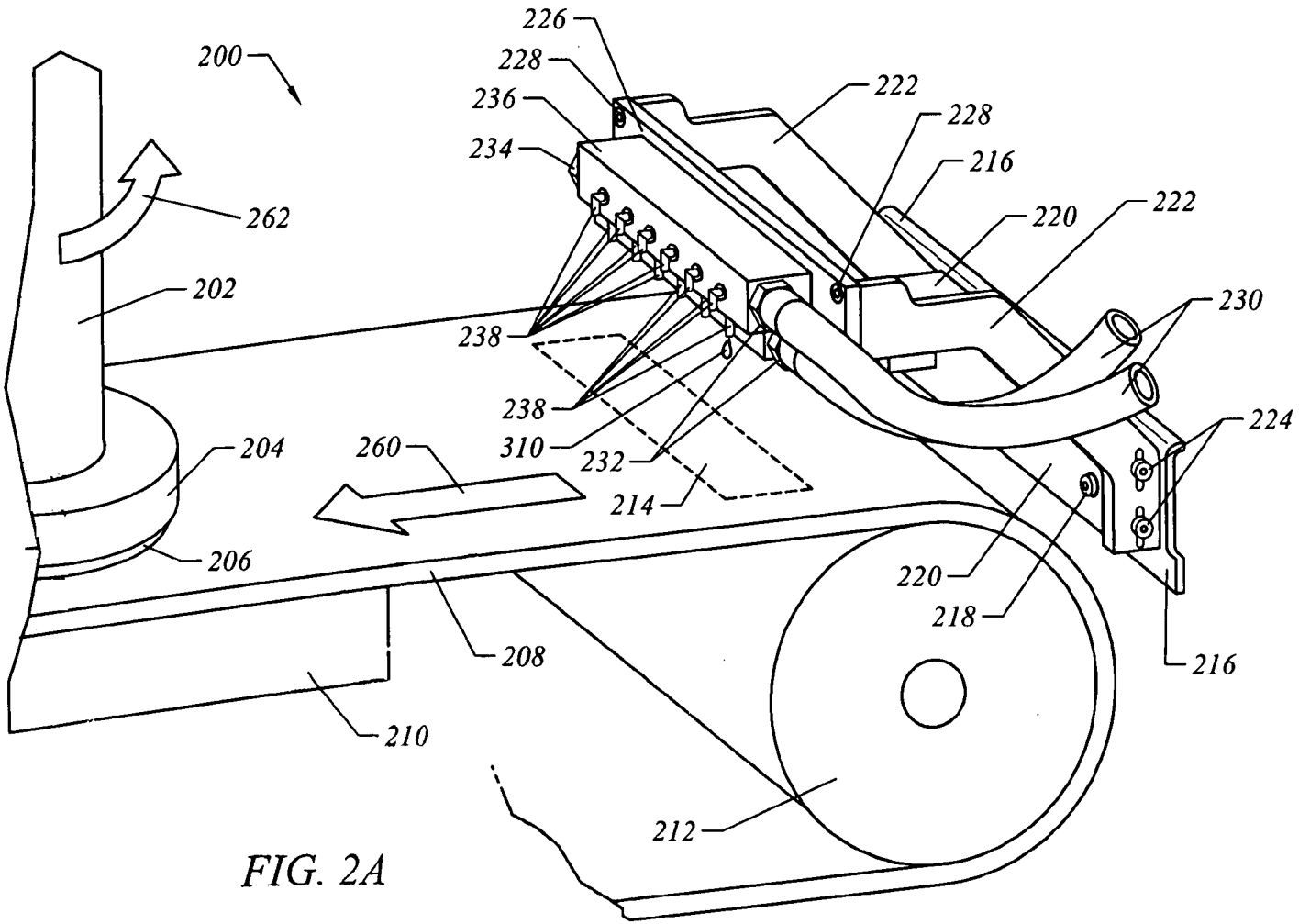
FIG. 2A shows a three-dimensional generalized diagram of a CMP system, in accordance with one embodiment of the present invention.

FIG. 2A shows a three-dimensional generalized diagram of a CMP system 200, in accordance with one embodiment of the present invention. The CMP system 200 includes a pair of drums 212, around which a polishing belt 208 rotates in a direction 260. A wafer 206 is attached to a carrier head 204 which is attached to a shaft 202. The shaft 202 rotates in a direction 262 while simultaneously applying downward pressure to generate friction at the wafer 206 and polishing belt 208 interface. A platen 210 is provided to stabilize the polishing belt 208 and to provide a solid surface onto which to apply the wafer 206. A liquid 310, such as slurry containing dispersed abrasive particles, is introduced upstream of the wafer 206 to facilitate the process of scrubbing, buffing, polishing, or planarizing the surface of the wafer 206. The liquid 310 is distributed to the polishing belt 208 within a distribution zone 214 via a manifold 236.

The manifold 236 includes a plurality of nozzles 238 which direct the flow of liquid 310 from an input line 230 downward toward the polishing belt 208. Each input line 230 is connected to a feed pump which supplies a flow of liquid 310. Each input line 230 is also connected to the manifold 236 by a threaded coupling 232. A threaded cap 234 is located opposite each input line 230 to prevent liquid 310 from leaving the manifold 236 other than through the nozzles 238.

The manifold 236 is mounted to a bracket faceplate 226 which is in turn connected to a pair of bracket arms 222 by a number of fasteners 228. The bracket arms 222 extend upward and outward over the polishing belt 208 to avoid interference with the manifold 236 and input lines 230. The lower ends of the bracket arms 222 are stabilized by a horizontal bar 220. The horizontal bar 220 and bracket arms 222 are held together by a number of fasteners 224. The horizontal bar 220 is mounted to a wall plate 216 by a number of fasteners 218.

Figure 2B:
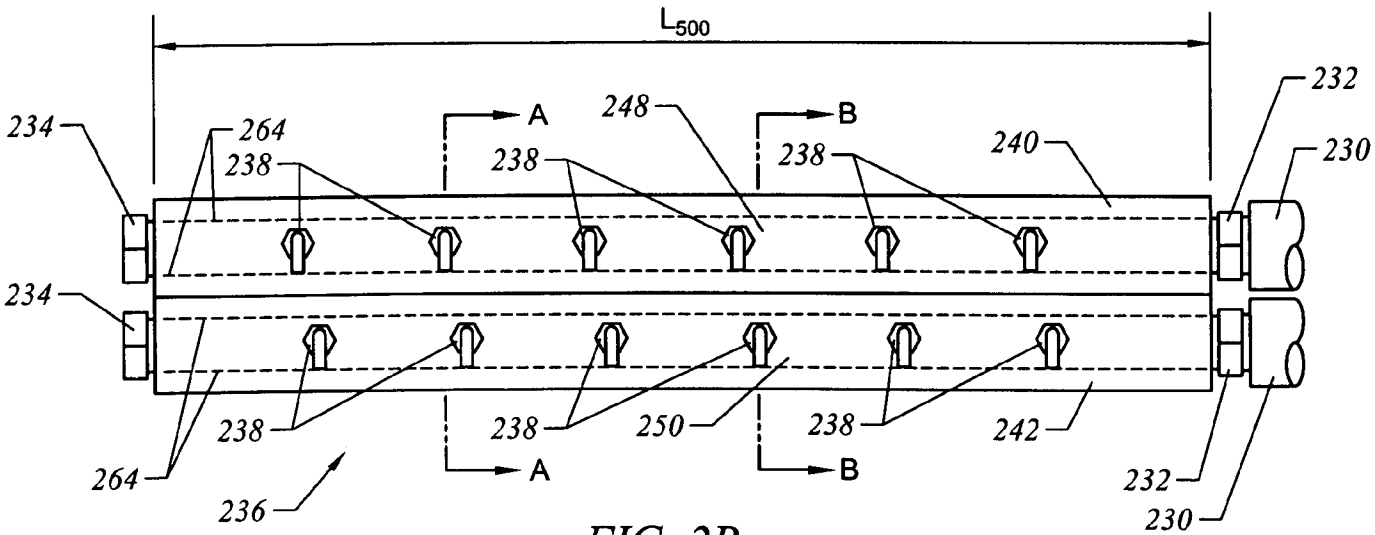
FIG. 2B shows the front view of a liquid dispense manifold, in accordance with one embodiment of the present invention.

FIG. 2B shows the front view of the manifold 236, in accordance with one embodiment of the present invention. The manifold 236 in this embodiment includes an upper region 240 containing a longitudinal bore 248 and a lower region 242 containing a longitudinal bore 250. The longitudinal bores 248 and 250 passing through the entire length of the manifold 236 are delineated by a set of dashed lines 264. A plurality of nozzles 238 access each longitudinal bore 248 and 250 such that liquid 310 may flow from the longitudinal bores 248 and 250 to the outside of the manifold 236 and downward toward the polishing belt 208. In the preferred embodiment, each longitudinal bore 248 and 250 has 6 nozzles 238 to ensure that an adequate liquid 310 distribution is achieved on the polishing belt. Each bore 248 and 250 is threaded on each end to accept either a threaded cap 234 or a threaded coupling 232. An input line 230 is connected to the threaded coupling 232 to provide liquid 310 to the manifold 236. Access to the inner region of each longitudinal bore 248 and 250 from either end facilitates manifold 236 servicing in the event of liquid 310 clogging.

Figure 2C:
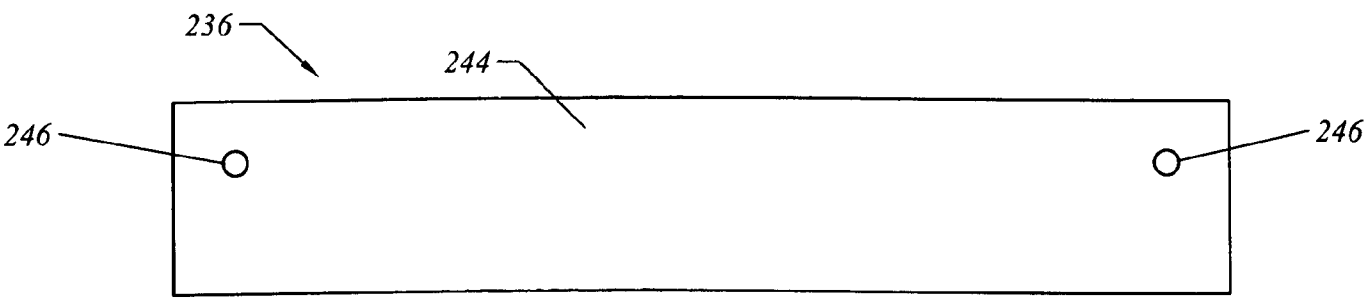
FIG. 2C shows the back view of a liquid dispense manifold, in accordance with one embodiment of the present invention.

FIG. 2C shows the back view of the manifold 236, in accordance with one embodiment of the present invention. The manifold 236 has a flat back surface 244 containing a pair of threaded mounting holes 246. The threaded mounting holes 246 are used to attach the manifold 236 to the bracket faceplate 226. Of course, any other suitable mounting technique will also work, so long as the manifold 236 is secure and placed at the proper height and location over the pad 208.

Figure 2E:
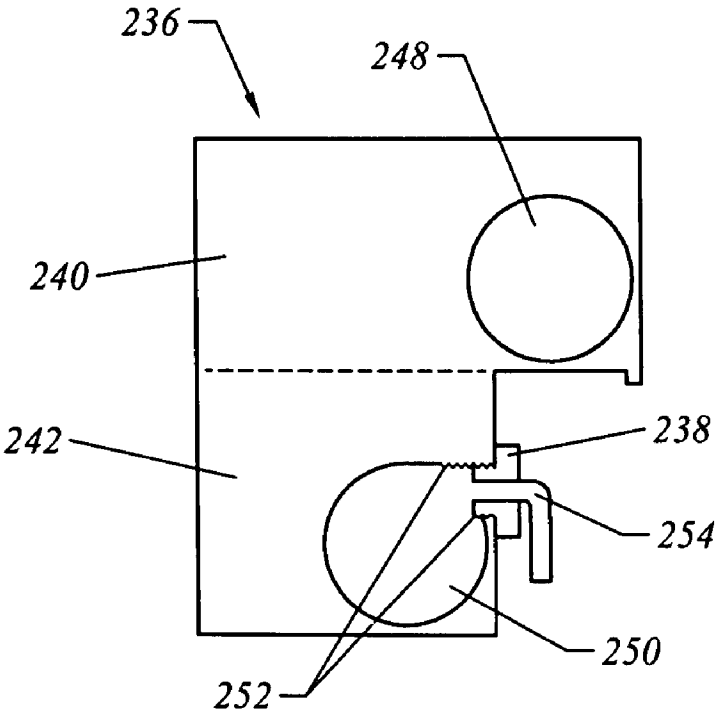
FIG. 2E shows a side cross-sectional view, referenced as B—B in FIG. 2B, of a liquid dispense manifold, in accordance with one embodiment of the present invention.
Figure 2D:
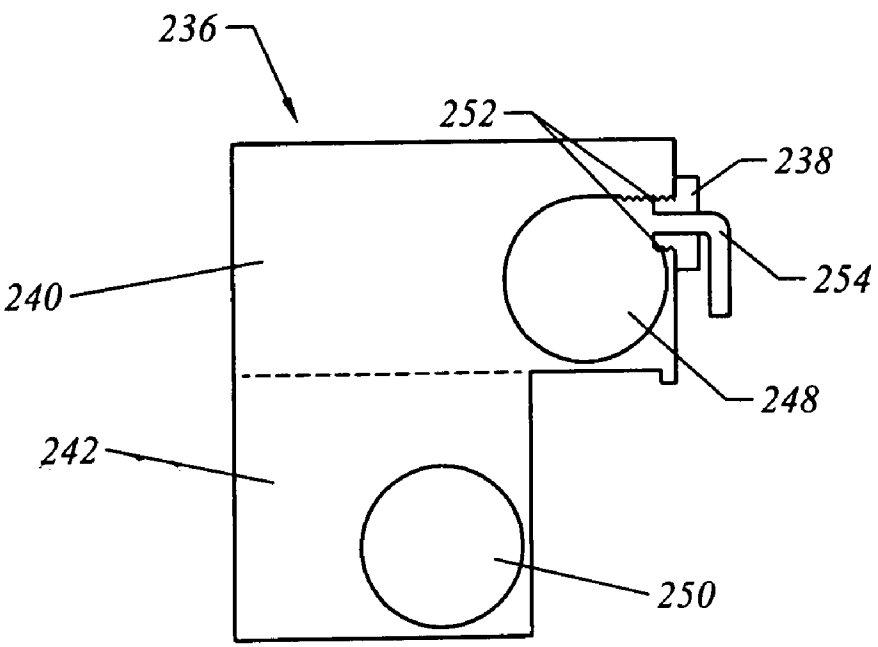
FIG. 2D shows a side cross-sectional view, referenced as A—A in FIG. 2B, of a liquid dispense manifold, in accordance with one embodiment of the present invention.

FIG. 2D shows a side cross-sectional view, referenced as A—A in FIG. 2B, of the manifold 236, in accordance with one embodiment of the present invention. The longitudinal bore 248 is shown in the upper region 240. Similarly, the longitudinal bore 250 is shown in the lower region 242. This cross-sectional view shows a slice through an upper region 240 nozzle 238. A receptor hole 252 is threaded to receive the nozzle 238. In this exemplary embodiment, the receptor hole 252 is positioned to be tangent to the topmost surface of the longitudinal bore 248.

FIG. 2E shows a side cross-sectional view, referenced as B—B in FIG. 2B, of the manifold 236, in accordance with one embodiment of the present invention. The longitudinal bore 248 is shown in the upper region 240. Similarly, the longitudinal bore 250 is shown in the lower region 242. This cross-sectional view shows a slice through a lower region 242 nozzle 238. A receptor hole 252 is threaded to receive the nozzle 238. This embodiment also has the receptor hole 252 is positioned to be tangent to the topmost surface of the longitudinal bore 250.

In one embodiment of the present invention, the nozzle receptor holes 252 are not toward the bottom of the longitudinal bore, thus alleviating the requirement to use a small sapphire orifice in the nozzle flow entrance to control liquid flow driven by gravity. The tangential position of the nozzle 238 receptor hole 252 relative to the longitudinal bore 248 and 250 top surface in the present invention facilitates an even flow of liquid 310 from the plurality of nozzles 238. The liquid 310 must fill the longitudinal bore 248 and 250 prior to reaching a nozzle 238 flow entrance. This design feature prevents liquid 310 from erratically entering and exiting nozzles 238 when subjected to a pulsed flow, such as what occurs when using a pulsing feed pump. As the liquid 310 begins flowing through the nozzles 238, the free volume remaining in the longitudinal bore 248 and 250 becomes pressurized. This pressurization creates a more evenly distributed flow through the plurality of nozzles 238 and also allows more precise flow control. The feed pump connected to the input lines 230 is metered so that liquid 310 flow rates from the nozzles 238 can be closely reproduced.

The longitudinal bores 248 and 250 dimensions and corresponding volume are defined according to the desired liquid 310 flow rate. For exemplary data, nominal flow rate is about 200 mL/min within a range from about 150 mL/min to about 1000 mL/min. Correspondingly, a nominal longitudinal bore 248 and 250 volume is about 1.2 $inch^3$ within a range from about 1 $inch^3$ to about 2 $inch^3$. For a CMP process on an 8 inch (i.e., 200 mm) diameter wafer 206, a nominal longitudinal bore 248 and 250 diameter of about 0.4 inch within a range from about 0.2 inch to about 0.5 inch may be expected. Similarly, for a CMP process on a 12 inch (i.e., 300 mm) diameter wafer 206, a nominal longitudinal bore 248 and 250 diameter of about 0.6 inch within a range from about 0.3 inch to about 0.7 inch may be expected.

Figure 3:
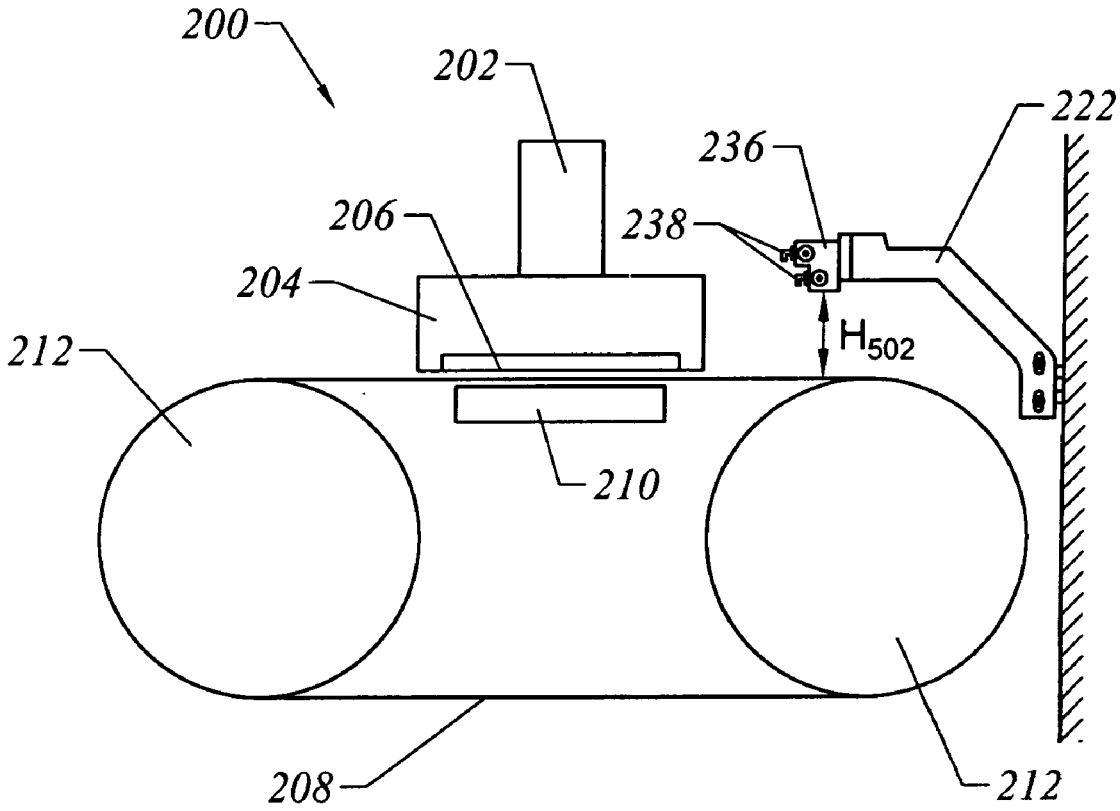
FIG. 3 shows a side view of the CMP system depicting the height of a liquid dispense manifold above the polishing belt, in accordance with one embodiment of the present invention.

FIG. 3 shows a side view of the CMP system 200 depicting a height $H_{502}$ of the manifold 236 above the polishing belt 208, in accordance with one embodiment of the present invention. The height $H_{502}$ of the manifold 236 relative to the polishing belt 208 is specified with a nominal dimension of about 3 inches within a range from about 1 inch to about 5 inches. To avoid liquid 310 splashing effects, the manifold 236 should not be positioned too far above the polishing belt 208.

Figure 4:
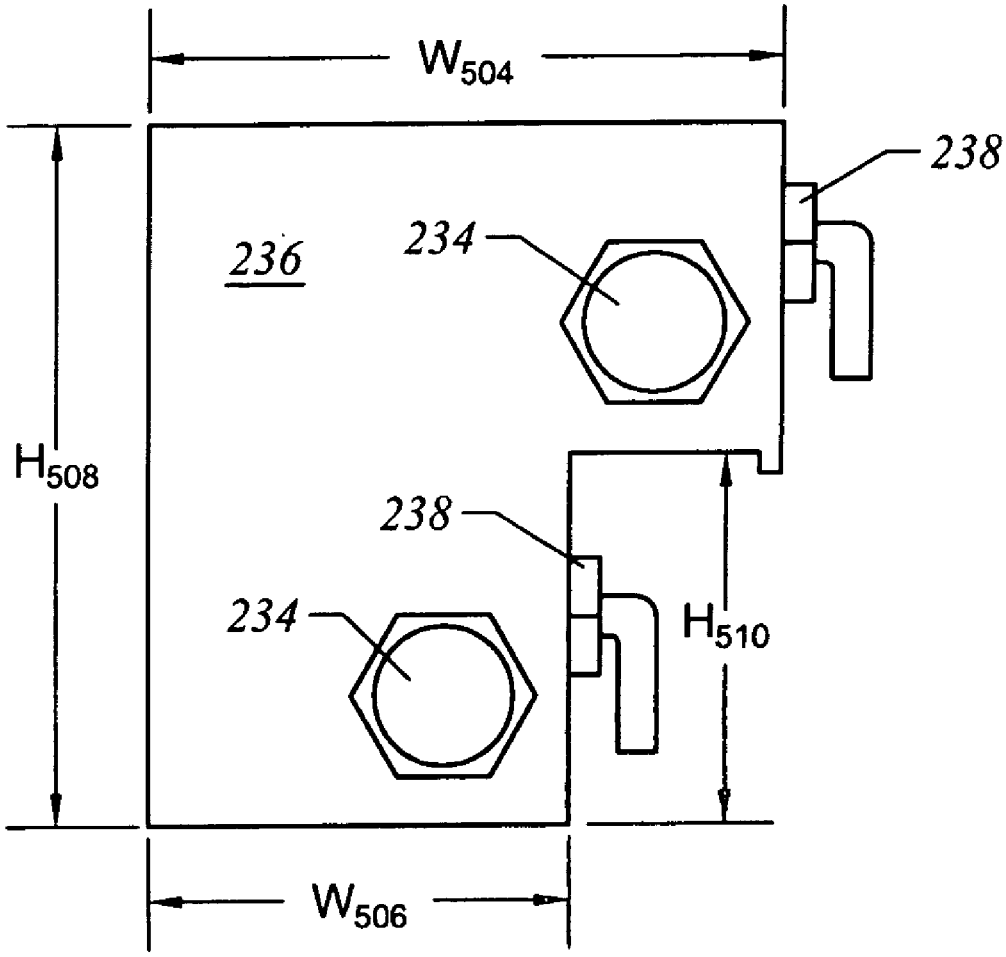
FIG. 4 shows an end view of a liquid dispense manifold depicting the outer dimensions of the manifold, in accordance with one embodiment of the present invention.

FIG. 4 shows an end view of the manifold 236 depicting the outer dimensions of the manifold 236, in accordance with one embodiment of the present invention. A manifold upper region width $W_{504}$ is specified with a nominal dimension of about 1.5 inch. A manifold lower region width $W_{506}$ is specified with a nominal dimension of about 1 inch. A manifold total height $H_{508}$ is specified with a nominal dimension of about 1⅝ inch. A manifold lower region height $H_{510}$ is specified with a nominal dimension of about ⅞ inches. A manifold length $L_{500}$, FIG. 2B, is specified with a nominal dimension of about 11 inches within a range from about 9 inches to about 12 inches. The manifold length $L_{500}$ may vary depending on the process target size (e.g., $L_{500}$ ≅about 11 inches for 8 inch (200 mm) wafer). It should be noted that the manifold 236 dimensions cited above are typical of the preferred embodiment of the present invention. Other embodiments of the present invention may have dimensions outside the ranges specified for the preferred embodiment.

Figure 5:
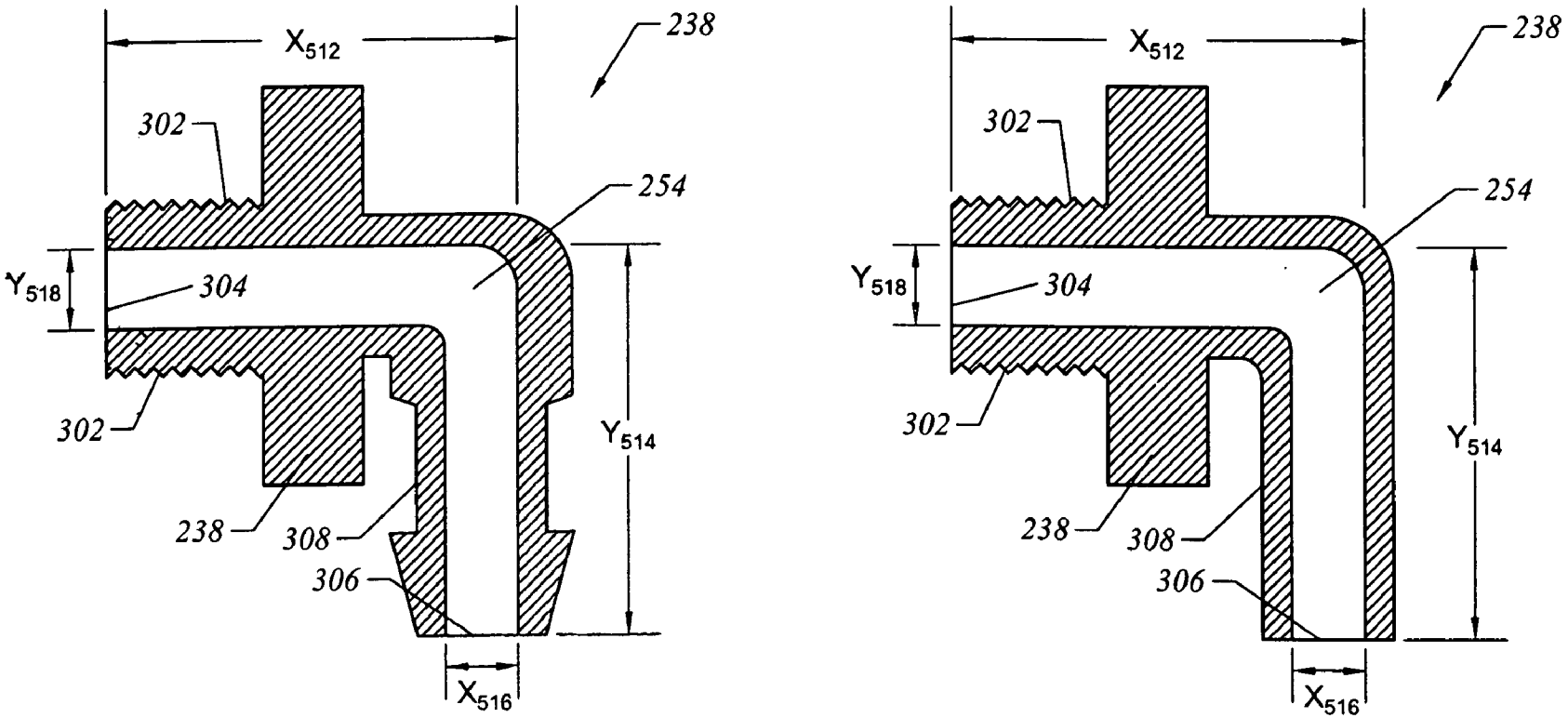
FIG. 5 shows cross-sectional views of nozzles depicting the nozzle characteristic dimensions, in accordance with an embodiment of the present invention.

FIG. 5 shows cross-sectional views depicting the nozzle 238 characteristic dimensions, in accordance with an embodiment of the present invention. The nozzle 238 includes a liquid entrance 304, a 90 degree bend 254, and a liquid exit 306. A set of threads 302 are present at the liquid entrance 304 end of the nozzle 238 to allow fit-up with a receptor hole 252 in the manifold 236. If necessary in the event of liquid 310 clogging, each nozzle 238 may be removed for servicing and replaced without damaging the manifold 236. The nozzle 238 portion outboard of the manifold 236 may have a contoured outer surface 308; however, there is no contour preference with respect to the present invention. A nozzle horizontal flow-path length $X_{512}$ is specified for each nozzle 238.

The nozzle horizontal flow-path length $X_{512}$ dimension is arbitrary; however, all nozzles should have a similar horizontal flow-path length $X_{512}$ dimension to ensure that equal flow rates are obtained from each nozzle. If the nozzle 238 flow-path diameter is too large, the liquid 310 flow rate will be too large. For a liquid 310 such as slurry, a nozzle horizontal flow-path diameter $Y_{518}$ is specified with a nominal dimension of about 0.04 inch within a range from about 0.03 inch to about 0.06 inch. Also, for a liquid 310 such as slurry, a nozzle vertical flow-path diameter $X_{516}$ is specified with a nominal dimension of about 0.04 inch within a range from about 0.03 inch to about 0.06 inch. For other liquids 310, such as de-ionized water, nozzle horizontal and vertical flow-path diameters $Y_{518}$ and $X_{516}$, respectively, may be specified with a nominal dimension of about 0.03 inch within a range from about 0.02 inch to about 0.09 inch.

A nozzle vertical flow-path length $Y_{514}$ is specified with a nominal dimension of about 0.2 inch within a range from about 0.1 inch to about 0.4 inch. The nozzle vertical flow-path length $Y_{514}$ should be long enough to allow the liquid 310 to make the 90 degree bend 254 and achieve a conditioned flow state prior to exiting the nozzle 238. However, the nozzle vertical flow-path length $Y_{514}$ must not be too long as to create a siphoning effect (i.e., increased flow rate) resulting from gravity acting on the liquid flow over a longer distance. In light of the above requirements, the nozzle vertical flow-path length $Y_{514}$ should be the same for each nozzle 238 to ensure that equal flow rates are achieved. As used herein, the 90 degree bend 254 is provided as an example, as other angles will also work so long as sufficient conditioning is applied to the fluid before exiting.

Figure 6:
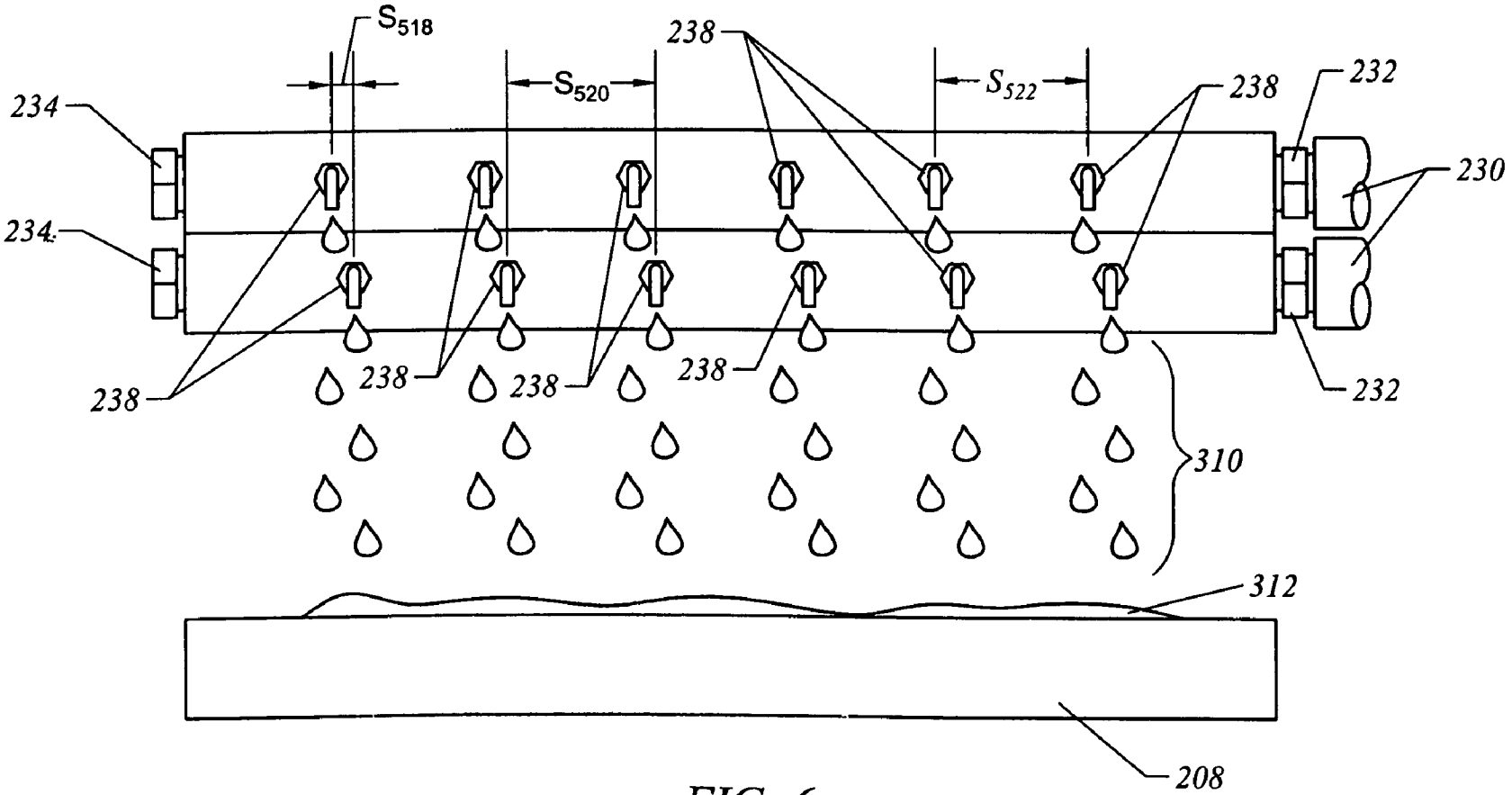
FIG. 6 shows a front view of a liquid dispense manifold depicting nozzle spacing dimensions and a corresponding liquid distribution, in accordance with one embodiment of the present invention.

FIG. 6 shows a front view of the manifold 236 depicting nozzle 238 spacing dimensions and a corresponding liquid distribution 312, in accordance with one embodiment of the present invention. The nozzle 238 locations along the manifold 236 have a direct effect on the liquid distribution 312 achieved on the polishing belt 208. In the preferred embodiment, an upper-to-lower region nozzle offset $S_{518}$ is specified to be approximately equal to about ¼ inch.

The upper-to-lower region nozzle offset $S_{518}$ is to ensure that liquid 310 flows do not overlap or get interrupted by other nozzles 238. In the preferred embodiment, an upper region nozzle center-to-center spacing $S_{522}$ is specified with a nominal dimension of about 1¼ inches. In the preferred embodiment, a lower region nozzle center-to-center spacing $S_{520}$ is specified with a nominal dimension of about 1¼ inches. Variations in liquid 310 chemistry and viscosity may require that other embodiments of the present invention use different nozzle 238 spacing dimensions. For example, a more viscous (i.e., thicker) liquid 310 may not spread as readily and may require closer nozzle 238 spacing to achieve the desired liquid distribution 312 on the polishing belt 208. Conversely, a less viscous (i.e., thinner) liquid 310 may spread more readily and may require larger nozzle 238 spacing to achieve the desired liquid distribution 312 on the polishing belt 208. The liquid distribution 312 size may vary depending on the process target size.

For example, a liquid 310 distribution zone 214 width of about 7 inches to about 8 inches may be required for an 8 inch (200 mm) wafer 206 diameter. Similarly, a liquid 310 distribution zone 214 width of about 10 inches to about 12 inches may be required for a 12 inch (300 mm) wafer 206 diameter. The plurality of nozzles 238 and flexibility with respect to nozzle 238 spacing ensure that an even and continuous liquid distribution 312 can be achieved across the polishing belt 208.

Figure 7:
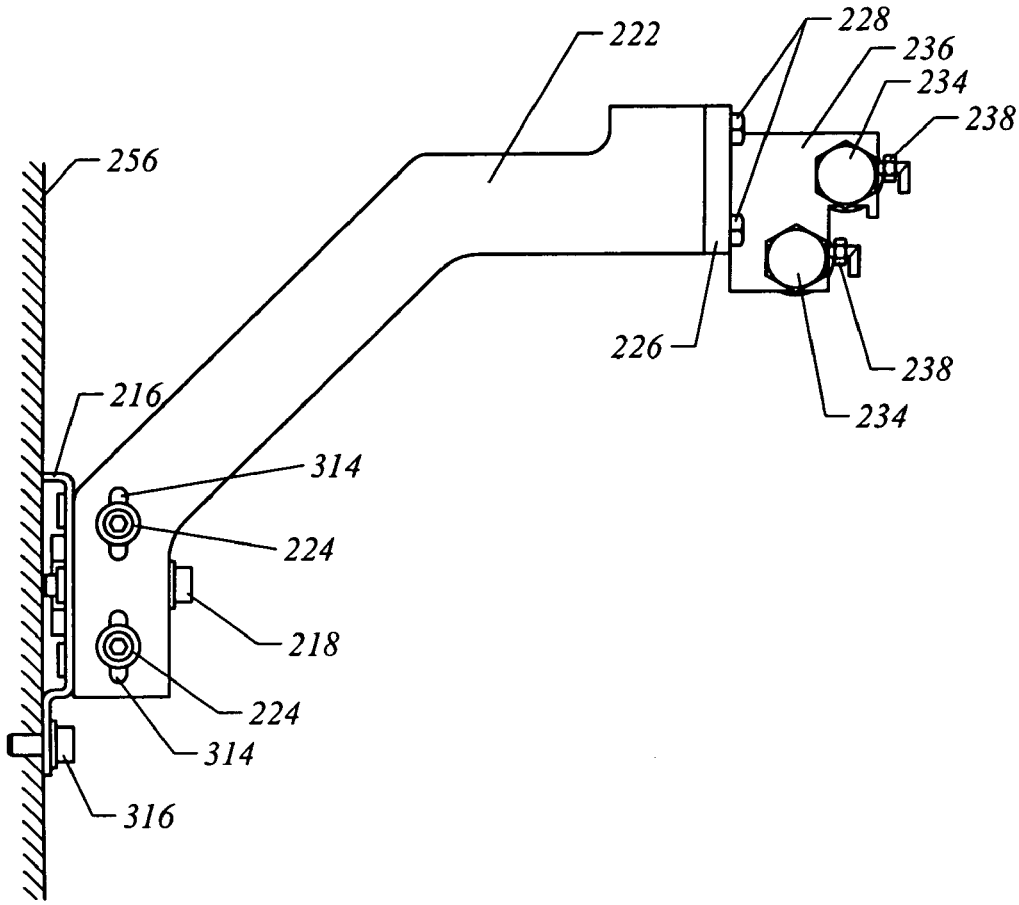
FIG. 7 shows a side view of a liquid dispense manifold mounting arrangement, in accordance with one embodiment of the present invention.
Figure 8:
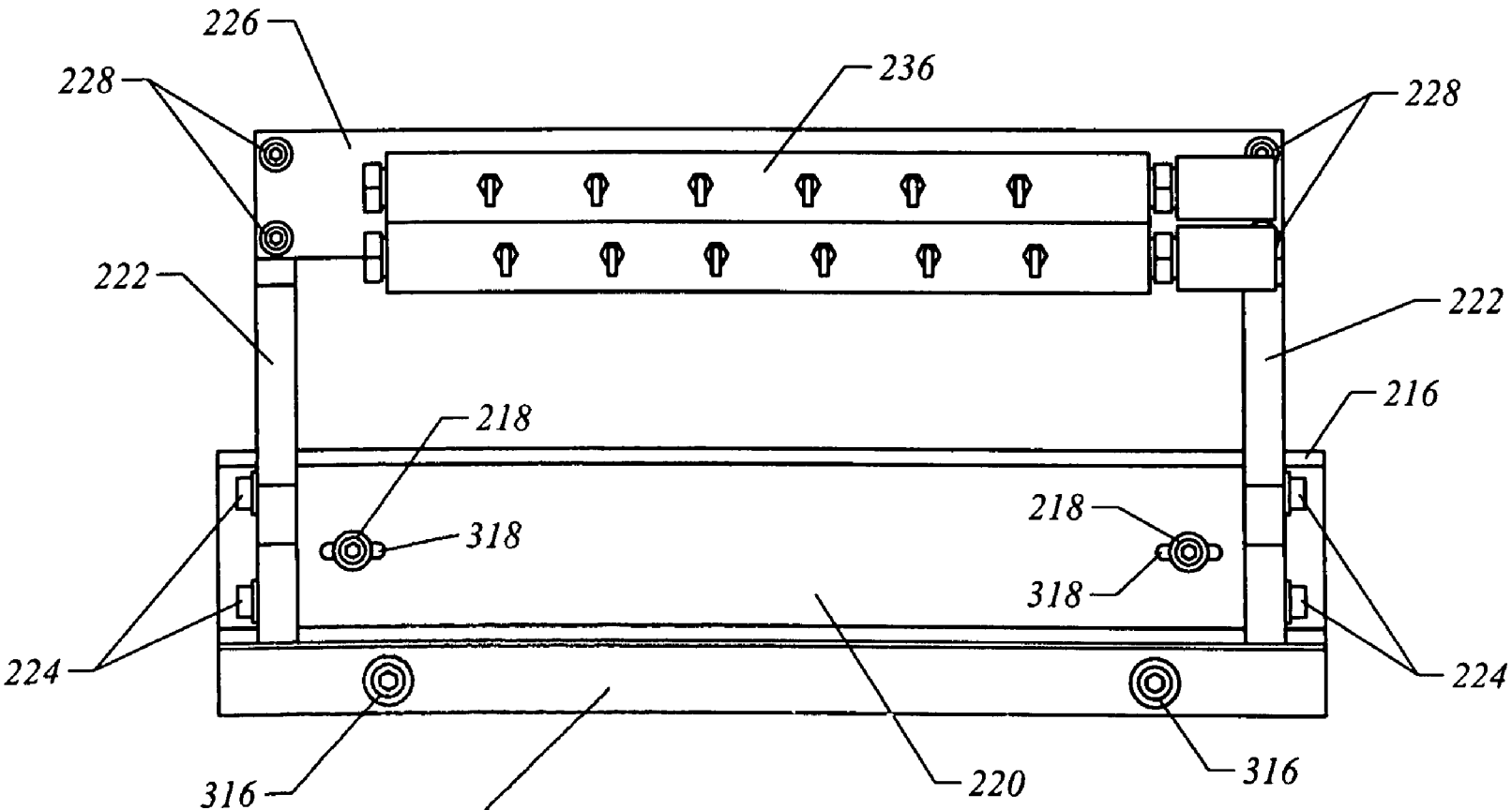
FIG. 8 shows a front view of a liquid dispense manifold mounting arrangement, in accordance with one embodiment of the present invention.

FIGS. 7 and 8 show a side view and a front view, respectively, of the manifold 236 mounting arrangement, in accordance with one embodiment of the present invention. The wall plate 216 is attached to the CMP system wall 256 by a number of fasteners 316. Each bracket arm 222 is attached to the horizontal bar 220 by a number of fasteners 224 passing through vertically elongated slots 314. The vertically elongated slots 314 allow the manifold 236 and associated mounting arrangement to be adjusted vertically as required. The horizontal bar 220 is attached to the wall plate 216 by a number of fasteners 218 passing through horizontally elongated slots 318. The horizontally elongated slots 318 allow the manifold 236 and associated mounting arrangement to be adjusted horizontally as required.

The preferred embodiment of the present invention having two longitudinal bores 248 and 250, offers more operational flexibility than previously allowed in the prior art. In the preferred embodiment of the present invention, one or both of the longitudinal bores 248 and 250 may be on at the same time. Generally, however, one longitudinal bore 248 and 250 is on at a time. Each longitudinal bore 248 and 250 may be fed the same or different liquid 310 compositions. This allows two liquid 310 compositions to be used for one CMP operation without having to mix liquids 310 in a longitudinal bore 248 and 250 or interrupt the CMP process to clean a longitudinal bore 248 and 250 and hook-up a second liquid 310 composition. Use of two or more liquid 310 compositions in a CMP process is common, thus a preferred embodiment of the present invention represents savings associated with decreased CMP system downtime and increased wafer throughput.

Figure 9:
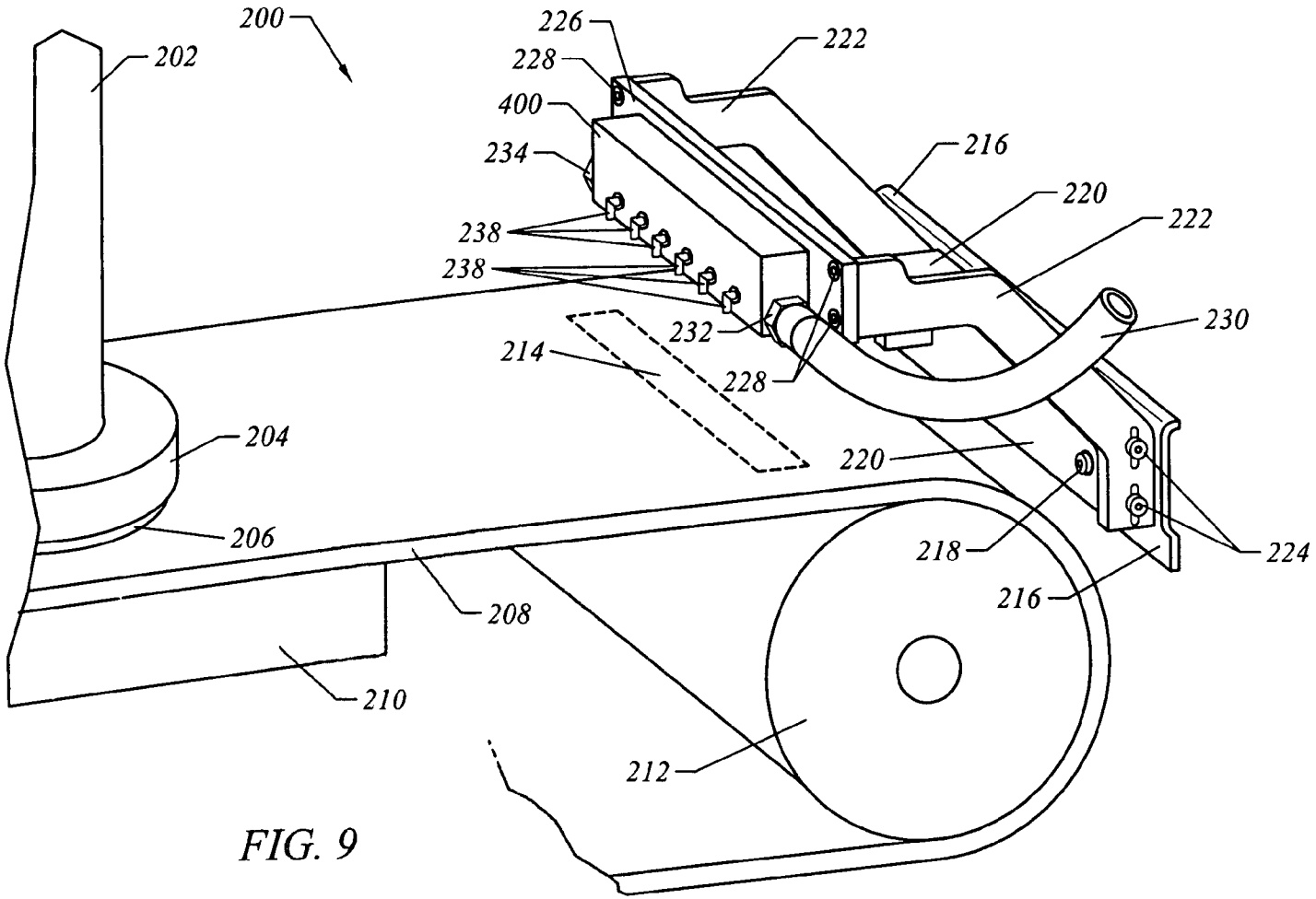
FIG. 9 shows a three-dimensional generalized diagram of a CMP system, in accordance with an embodiment of the present invention.

FIG. 9 shows a three-dimensional generalized diagram of a CMP system 200, in accordance with another embodiment of the present invention. In this embodiment, all components of the CMP system 200 and manifold mounting arrangement remain the same; however, a single longitudinal bore manifold 400 is implemented. The input line 230, threaded coupling 232, threaded cap 234, bore characteristics, and nozzle 238 characteristics remain the same as in the previous embodiment.

Figure 10:
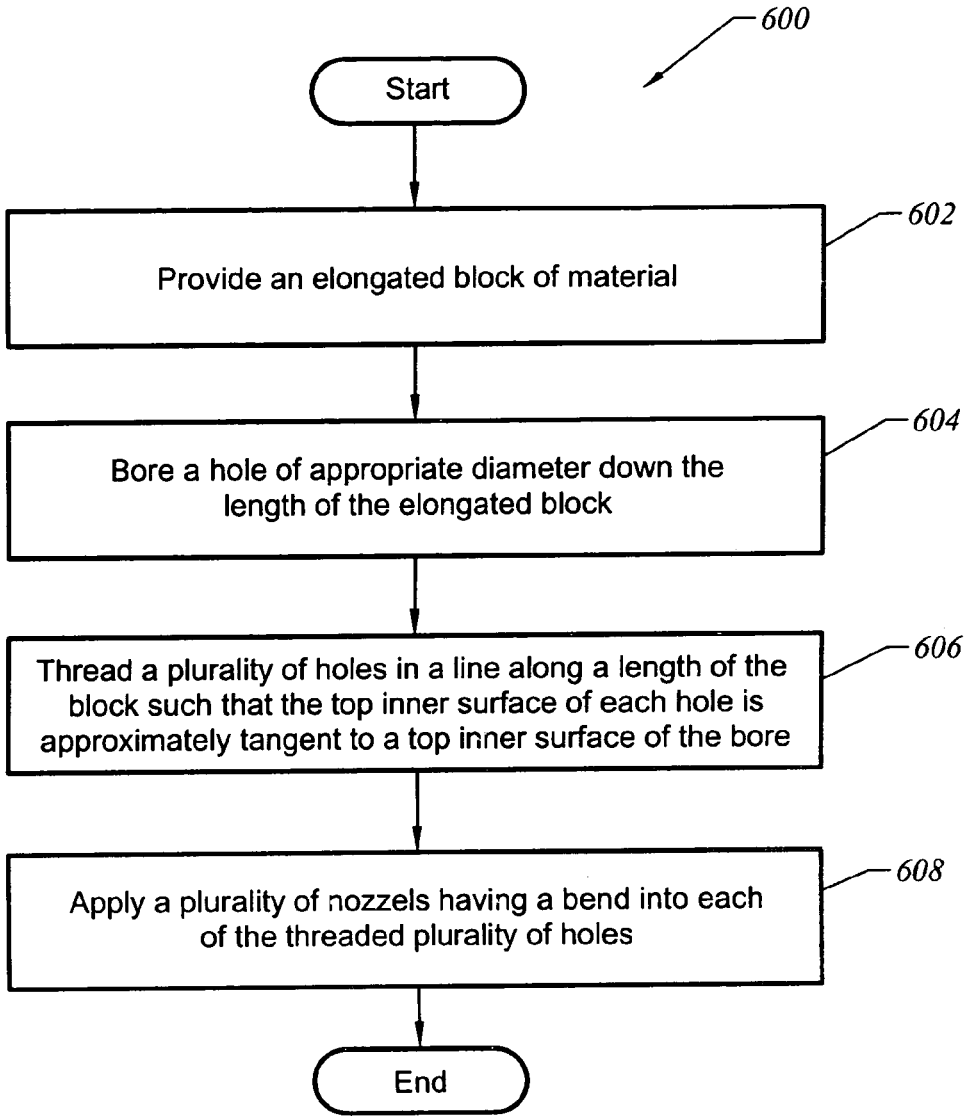
FIG. 10 is a flow chart illustrating the method operations implemented to make a manifold, in accordance with one embodiment of the present invention.

FIG. 10 is a flow chart illustrating the method operations implemented to make a manifold 236, in accordance with one embodiment of the present invention. The method 600 begins where an elongated block of material is provided in 602. A bore having an appropriate diameter is then defined down the length of the elongated block in operation 604. In operation 606, a plurality of holes are threaded in a line along a length of the block, such that the top inner surface of the each hole is approximately tangent to a top inner surface of the bore. In operation 608, a plurality of nozzles having a bend is applied into each of the plurality of threaded plurality of holes. The manifold 236 can then be supplied with the appropriate supply lines to deliver fluid to the bore, and allow the fluid to exit each of the nozzles in an even and controlled fashion over a CMP polishing surface.

In a more specific exemplary embodiment, the method of making a liquid dispense manifold for a CMP system is now provided. Operation 1 of the method is to obtain or fashion an elongated block of material that can be drilled or bored through. The elongated block may be rectangular, cylindrical, or any other shape. Operation 2 of the method is to bore a hole of appropriate diameter down the entire length of the block fashioned in Operation 1. Operation 3 of the method is to thread approximately 1 inch at each end of the bore hole created in Operation 2. Operation 4 of the method is to drill and thread a plurality of holes in a straight line along the length of the block such that the top inner surface of each hole is approximately tangent to the top inner surface of the bore created in Operation 2. Each of the plurality of holes drilled and threaded in Operation 4 should preferably be approximately perpendicular to the bore hole created in Operation 2.

Operation 5 of the method is to drill and thread at least 2 holes on the on the side of the block directly opposite the plurality of holes created in Operation 4. The holes created in Operation 5 should not penetrate to the bore hole created in Operation 2. The holes created in Operation 5 are used to mount the liquid dispense manifold. Operation 6 of the method is to fashion or obtain a plurality of identical nozzles having appropriate dimensions, e.g., such as a 90 degree bend (or any angle that will provide sufficient conditioning), and a threaded flow entrance end to match the threading performed in Operation 4. Operation 7 of the method is to screw the nozzles obtained in Operation 6 into the plurality of holes created in Operation 4. Operation 8 of the method is to obtain a threaded end cap to match the threads created in Operation 3. Operation 9 of the method is to screw the end cap obtained in Operation 8 into one end of the bore created in Operation 2. Operation 10 of the method is to obtain a threaded coupling to match the threads created in Operation 3. Operation 11 of the method is to screw the coupling obtained in Operation 10 into the bore end opposite of the end cap as placed in Operation 9.

Operation 12 of the method is to mount the liquid dispense manifold as created in Operations 1 through 11 of the method to a manifold mounting bracket in the CMP system. Operation 13 of the method is to attach the liquid input line for the CMP system to the coupling attached in Operation 11. Operations 1 through 13 above define one exemplary detailed method for making a liquid dispense manifold for mounting and connecting to a CMP system. Operations 1 through 13 above, however, are not inclusive in the respect that someone skilled in the art may make obvious modifications or additions depending on the desired location, the specific CMP system, space considerations, engineering requirements, and ergonomics.

The material selection for each component of the liquid dispense manifold 236 is arbitrary so long as the selected materials are chemically compatible with the liquid 310. In the preferred embodiment of the present invention, the manifold 236 and nozzles 238 are composed of plastic to reduce the overall cost of the apparatus. It should be noted that the required manifold 236, longitudinal bore 248 and 250, and nozzle 238 dimensions do not necessarily required precision machining depending on the materials selected. For example, use of less expensive molded plastic nozzles 238 rather than machined metal nozzles 238 is acceptable.

While this invention has been described in terms of several preferred embodiments, it will be appreciated that those skilled in the art upon reading the preceding specifications and studying the drawings will realize various alterations, additions, permutations and equivalents thereof. It is therefore intended that the present invention includes all such alterations, additions, permutations, and equivalents as fall within the true spirit and scope of the invention.

What is claimed is:

1. A fluid dispense manifold for use in a substrate processing system, comprising:

an elongated body having at least a length, a bottom region, and a side region;

a bore defined through the length of the elongated body, the bore having a first diameter;

a plurality of holes defined along the length of the elongated body through the side region to the bore, each of the plurality of holes having a second diameter that is less than the first diameter of the bore, a topmost surface of each of the plurality of holes being substantially tangent to a topmost surface of the bore such that a bottommost surface of each of the plurality of holes is positioned above a bottommost surface of the bore; and a plurality of nozzles, each of the plurality of nozzles capable of being attached to each of the plurality of holes, each of the plurality of nozzles having a bend designed to direct a fluid flow capable of emanating from within the bore, out through the side region and toward the bottom region, the fluid flow capable of being directed onto a surface that is oriented beneath the bottom region, each of the plurality of nozzles being configured to direct the fluid flow downward in a form of substantially uniform drops.

2. A fluid dispense manifold as recited in claim 1, wherein the surface that is oriented beneath the bottom region is substantially perpendicular to the side region.

3. A fluid dispense manifold as recited in claim 1, wherein the bend is approximately 90 degrees.

4. A fluid dispense manifold as recited in claim 1, wherein the bore defined through the length of the elongated body is configured to receive a supply line for delivering the fluid flow.

5. A fluid dispense manifold as recited in claim 1, wherein the plurality of holes each define a path to the bore, and each hole is threaded.

6. A fluid dispense manifold as recited in claim 1, wherein the fluid flow passage of each of the plurality of nozzles includes a first passage portion defined between the entry and the bend, the first passage portion being oriented to direct the fluid flow capable of emanating from within the bore in a horizontal direction.

7. A fluid dispense manifold as recited in claim 1, wherein the surface is chemical mechanical polishing pad surface.

8. A fluid dispense manifold as recited in claim 1, wherein the bend is configured to provide a conditioning path for the fluid flow.

9. A fluid dispense manifold as recited in claim 1, wherein the fluid flow is a slurry fluid flow.

10. A fluid dispense manifold as recited in claim 1, wherein the fluid dispense manifold is attached to bracket arms, the bracket arms positioning the fluid dispense manifold over a width of a linear polishing pad of a chemical mechanical planarization system.

11. A fluid dispense manifold as recited in claim 1, wherein the elongated body has a second bore, a second set of holes, and a second set of nozzles.

* * * * *